United States Patent [19]

Stobb

[11] 4,444,387

[45] Apr. 24, 1984

[54] SHEET STACKER WITH A SEPARATOR PLATE

[75] Inventor: Walter J. Stobb, Pittstown, N.J.

[73] Assignee: Stobb, Inc., Clinton, N.J.

[21] Appl. No.: 392,333

[22] Filed: Jun. 28, 1982

[51] Int. Cl.[3] ..... B65H 29/34

[52] U.S. Cl. ..... 271/189; 271/215; 271/218

[58] Field of Search ..... 271/189, 213, 214, 215, 271/217, 218

[56] References Cited

U.S. PATENT DOCUMENTS

| | | | |
|---|---|---|---|
| 3,825,134 | 7/1974 | Stobb | 271/215 X |
| 3,969,993 | 7/1976 | Stobb | 93/93 C |
| 4,372,201 | 2/1983 | Dudziak | 271/215 X |

*Primary Examiner*—Richard A. Schacher
*Attorney, Agent, or Firm*—Arthur J. Hansmann

[57] ABSTRACT

A sheet stacker with a separator plate having a movable stacker table with a stack supporter thereon. A first drive means is utilized for alternately lowering the separator plate and the stacker table, and a second drive means is utilized for alternately raising the separator plate and the stacker table. The second drive means is constantly running and two clutches are respectively interposed between the drive means and the plate and table and that second drive means is constantly running and is overcome by the downward drive means, but is effective upon suitable alternate actuation of the two clutches for the plate and the table.

5 Claims, 4 Drawing Figures

FIG. 3
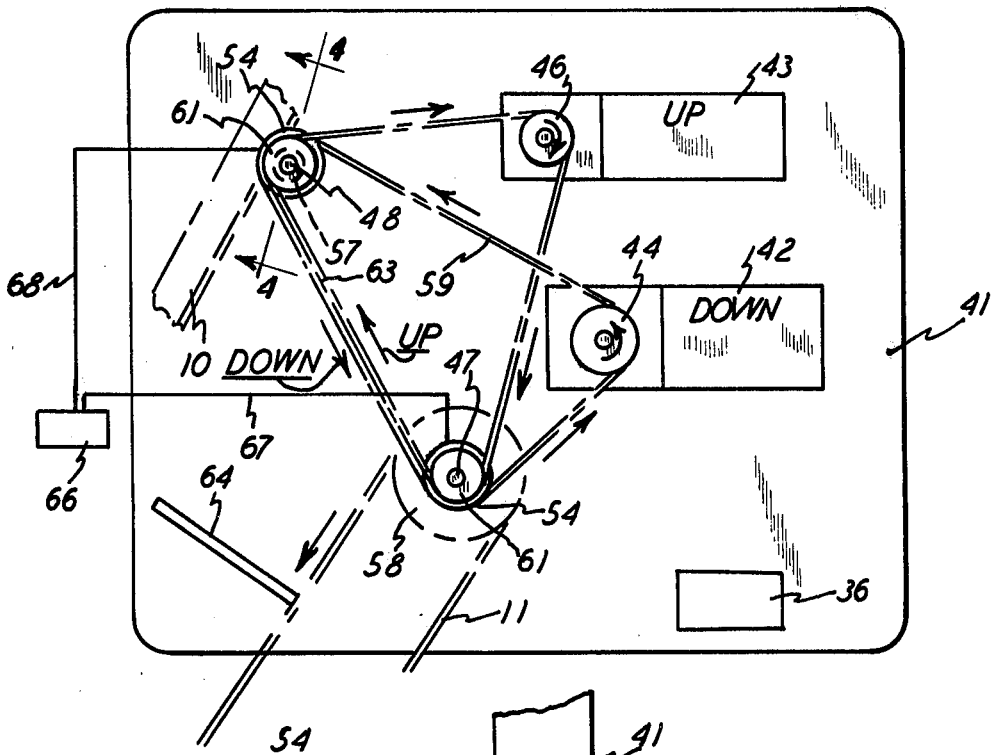
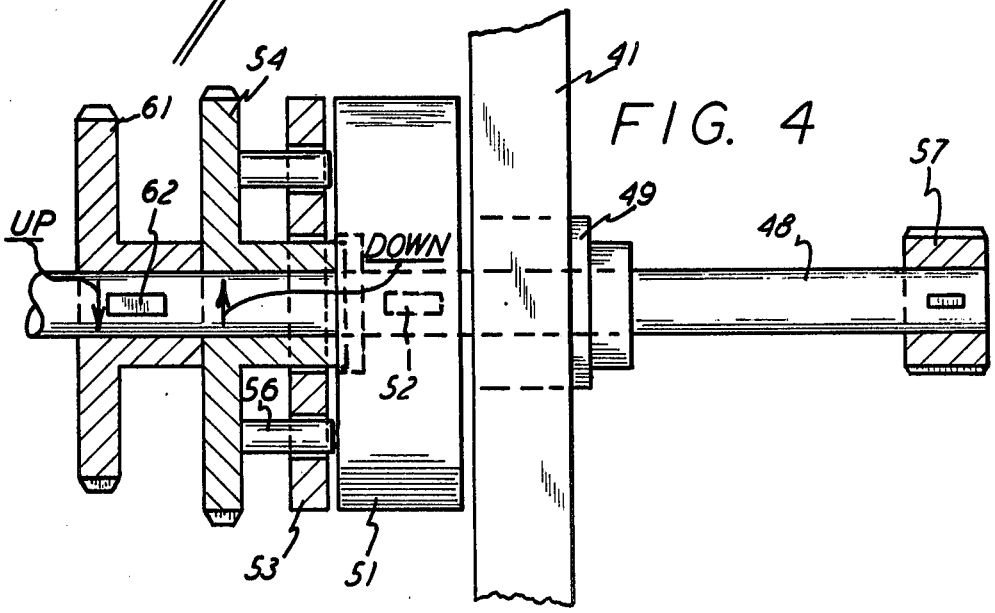
FIG. 4

SHEET STACKER WITH A SEPARATOR PLATE

This invention relates to a sheet stacker with a separator plate, and, more particularly, it relates to a sheet stacker and separator plate assembly wherein the sheets are counted as they pass into the stack.

BACKGROUND OF THE INVENTION

Sheet stackers with separator plates are known in the prior art. For instance, U.S. Pat. No. 3,969,993 shows a sheet stacker with a separator plate (and that patent is incorporated in this disclosure for purposes of reference as needed by anyone requiring further disclosure in the present case). That type of prior art stacker receives a stream of overlapped sheets and ultimately collects the stream and places its sheets into a final stack. In that process of stacking, a separator plate is used to intercept the initial formation of the stack, and a sheet counter operates the separator plate so that the final stack is composed of a determined and selected number of sheets controlled by the counter. That is, after the determined number of sheets have passed into the final stack on the stacker table or conveyor, than the separator plate is actuated so that it intercepts the remaining sheets headed toward the stack and separates those sheets from the initially formed stack so that the initially formed stack can be moved away and tied in its desired number of sheets, and then the entire process is repeated when the separator plate is withdrawn and the next stack is allowed to fully form on the stacker table.

Prior art U.S. Pat. No. 3,969,993 shows that its separator plate is controlled by mechanical means which includes a parallelogram type of linkage support for the plate so that the plate can move up and down along a straight line, as required. That is, the particular mounting of that separator plate is entirely mechanical means, and it requires the mounting arms and interconnecting support members, and, more particularly, it requires a spring and connecting elements for the return or upward movement of the separator plate.

The present invention improves upon the prior art in that it does not require the cumbersome, costly, and generally mechanical mounting for the separator plate, particularly including the mechanical elements required for returning the plate to its up position, namely, the springs, fluid-actuated cylinders, hydraulic dampers, or the like. Therefore, the present invention simplifies the prior art in the mounting and control for the up and down movement of the separator plate.

Specifically, the present invention provides one driving member for moving the stacker table and the separator plate in their downward movements, and it provides one driving member for moving the stacker table and the separator plate in their upward movements. A clutch is respectively used with the stacker table and with the separator plate so that they move downward and upward alternately, in the desired manner.

In broad concepts, the present invention improves upon the prior art in providing a lower cost and more simplified structure for a stacker with a separator plate, and the structure of the present invention is more reliable in its action in that it has fewer mechanical parts.

Other objects and advantages will become apparent upon reading the following description.

BRIEF DESCRIPTION OF THE DRAWINGS

FIG. 2 is an enlarged section view of a portion of FIG. 1.

FIG. 3 is a side elevational view of the drive means of this invention for both the stacker table and the separator plate.

FIG. 4 is an enlarged sectional through one of the clutches and drive members taken on the line 4—4 of FIG. 3.

DETAILED DESCRIPTION OF THE PREFERRED EMBODIMENT

Figure 1:
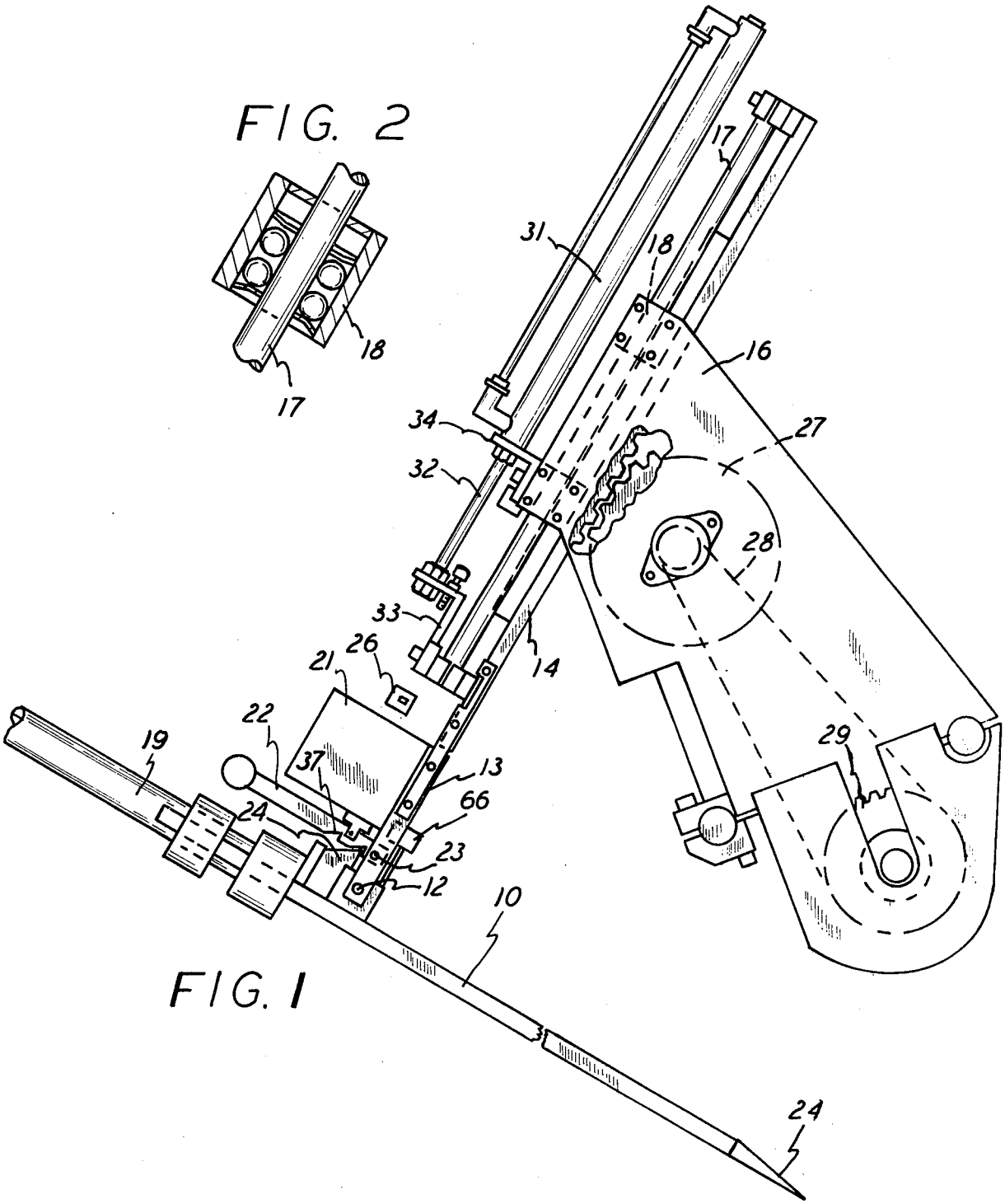
FIG. 1 is a side elevational view of a separator plate and its particular mounting for a stacker.

For further background, U.S. Pat. No. 3,969,993 and FIG. 1 of the present case both show the mounting of a separator plate which is plate 10 in FIG. 1. One skilled in the art will readily understand that the plate 10 moves along the path of the collected stack of sheets when the plate intercepts the sheets coming in stream form onto the plate, such as shown and described in the said patent. Also, one will readily understand that there is a table or collector conveyor, such as the table 11 in FIG. 3, and the stack of sheets is formed and supported on the table which moves up and down, but at the angulation shown. The general concept is to utilize a sheet counter which controls the positioning of the separator plate 10 into the path of the sheets after a certain and selected number of sheets have passed to the stacker table mentioned. At that time, the separator plate is actuated to be inserted into the path of the stream of sheets and thereby intercept the sheets while the previously formed stack is removed. Both the stacker table and the separator plate are moved upwardly to their return positions ready for receiving the next sheets, all as described in said patent which is incorporated herein to the extent necessary for that background information.

The said patent shows a parallelogram type of linkage mounting for the separator plate to support and move the plate in its up and down action, and FIG. 1 also shows a support for the separator plate 10 and it shows mechanism for moving the plate up and down. The present invention is concerned only with the manner of moving the plate 10 in its upward movement.

FIG. 1 shows the separator plate 10 to be pivotally mounted on a pin 12 on the lower end of a support 13 which is an extension of a gear rack 14. The rack 14 is slidable up and down, at the angle shown, in a suitable frame or like support 16, and FIG. 2 shows a slidable cylindrical rod 17 in a conventional type of bearing mounting 18 suitably supported on the frame or the like 16 for guiding the rack 14 in its up and down movement. That is, when the separator plate 10 is in its operative position and intercepting the sheets coming toward the stacker table 11, the rack 14 moves downwardly and thus lowers the separator plate 10 to accomodate the growing stack of sheets on the plate 10. Then, when the stack previously formed and on the table 11 is removed, then the separator plate 10 can be retracted by means of the fluid cylinder 19 attached to the separator plate 10 for extension and retraction of the plate 10, and the plate 10 is then clear of the stack which was on the plate 10, and the rack 14, along with the plate 10, can then be moved upwardly for the next cycle of action. Further, it is also conventional to employ an electric solenoid 21 which actuates a latch 22 pivotal about the pin 23 on the extension 13. The latch 22 engages a latch plate 24 affixed to the separator plate 10 to hold the separator plate against further clockwise rotation as viewed in FIG. 1. At any convenient time when the previously formed stack is sufficiently managed relative to the stack table 11, then the cylinder 19 can be actuated, in any conventional arrangement of a switch, such as a switch 26 in the path of movement of the rack 14 and guide rod 17, and that conventional switch can govern the air flow of fluid to the cylinder 19 to retract the separator plate 10 relative to the cylinder 19, and thus allow the partial stack that was on the plate 10 to pass to the control of the table 11, in the conventional manner. The plate 10 with the cylinder 19 are then overbalanced to where they rotate about the pin 12 in a counterclockwise direction, as viewed in FIG. 1, and thus the plate 10 is in the next ready position for intercepting sheets. The rack 14 and the plate 10 are then moved upwardly, by means of return spring and other mechanism unshown by conventional means of a mechanism of a pinion 27 actuated through a sprocket chain 28 and a drive sprocket 29. Of course the pinion 27 was utilized for controlling the downward movement of the plate 10 when the drive sprocket 29 was rotated in the counterclockwise direction, as viewed in FIG. 1.

Upon the upward movement of the plate 10, a dampener fluid cylinder 31 is shown attached through its rod 32 and a bracket 33 to the slide rod 17. The cylinder 31 is mounted on the frame 16 through a bracket 34. An extension spring of a conventional arrangement but unshown herein is suitably attached between the separator plate 10 and the frame 16 for the upward movement of the separator plate, as described, and that upward movement is dampened by the cylinder 31.

When a sufficient number of sheets have passed to the table 11, then a sheet counter, such as the conventionally used laser counter 36 shown in FIG. 3, actuates the solenoid switch 21 to which it is suitably connected, and the latch 22 with its notch 37, withdrawn from the latch stop 24 and, with the extension of the plate 10 suitably arranged through the pneumatics described with cylinder 19, the plate 10 will again rotate to the position shown in FIG. 1 and thus its point 24 will dip into the incoming stream and again commence to intercept the incoming sheets, and the cycle is repeated.

All of the foregoing is to be understood from the said patent as well as from the description and drawings incorporated herein.

The contribution of the present invention is shown in FIGS. 3 and 4 where a stacker frame 41 suitably supports drive members 42 and 43 which respectively have rotatable drive sprockets or pulleys 44 and 46. Also, driven shafts 47 and 48 are suitably mounted on the frame 41, such as by the bearing 49 shown in FIG. 4, and these two shafts each have an electromagnetic clutch element 51 affixed to the shaft through a key 52. A clutch plate 53 is adjacent the element 51, and a driven sprocket or like member 54 is rotatably mounted on the shaft 48, as shown. The sprocket 54 carries pins 56 which extend into driving relation with the plate 53 which is magnetically attracted by the element 51 when the element 51 is electrically energized, all in the conventional and well-known arrangement for an electric clutch. The shaft 48 has a pinion 57 keyed thereto, and the shaft 47 has a sprocket 58 keyed thereto. The pinion 57 is comparable to the pinion 27 in FIG. 1 and is in gear-tooth relationship with the rack 14 for moving the rack up and down, as described in connection with FIG. 1. The sprocket 58 is in driving relation with the stacker table 11 which may be a sprocket chain of a conventional arrangement, and thus the chain can move up and down upon clockwise and counterclockwise rotation of the sprocket 58.

Therefore, the drive means 42 will rotate its driving member 44 in a counterclockwise direction, and, a sprocket chain or the like 59 is in endless driving relation with the two sprockets 54 such that, upon energizing the clutch 51, the sprocket 54 is rotated and the sprocket chain 59 moves in the direction of the arrows marked "down", and thus the separator plate on the rack 14 will move down, and the table 11 will also move down but at a time alternate with the downward movement of the rack 14, as hereinafter described.

Another sprocket or the like 61 is mounted on each of shaft 47 and 48, and is secured thereto by a key 62. A drive sprocket chain or the like 63 extends endlessly over the two sprockets 62 and the drive member 46 of the drive mechanism 43. Thus, as shown by the arrows marked "up", the separator plate 10 and the stacker table 11 are moved alternately to the upward positions. Thus, the drive 43 is a retract drive, and, along with its output member 46 and the sprocket chain or the like 63, it forms a drive means for the upward movement of the separator plate 10 and the stacker table 11 which has the usual backstop or support 64 for receiving the stack and supporting it as the table 11 moves in the direction of the arrow for its downward movement. The drive 43 can be a torque motor, eddy current clutch drive, particle clutch drive, or the like. It is constantly running, and, in actuality, it is simply overcome by the drive 42 when the drive 42 is engaged for the downward action of the separator plate 10 and the stacker table 11.

Thus, the electric motor or drive 43 is running constantly and is overcome, by the fact of being a lesser powered drive compared to the electric motor or drive 42 and its drive chain 59, when the plate 10 is driven downwardly and when the table 11 is driven downwardly at an alternate time. At the appropriate moment when it is desired to lower the completed stack, the drive 42 can be disengaged, by means of its electromagnetic clutch 51, and the table 11 will then be rapidly lowered so that the stack theron can be moved away. Subsequently, the lower support 64 is raised upwardly in response to the reverse or upward movement of the table 11, and that upward movement for both the separator plate 10 and the table 11 is created by the drive 43 when the electromagnetic clutch 51 is disengaged. That is, the two clutches 51 on the shafts 47 and 48 are engaged only for the downward movements at which time the drive 43 is being overpowered, but is constantly running, and is available for the drive in the upward movement of both the plate 10 and the table 11, and that upward movement occurs whenever the respective clutch 51 is disengaged.

Thus, when a counter, such as the counter 36 adjacent the stream of sheets and of a conventional arrangement such as in said patent, is satisfied, then the solenoid 21 which can be conventionally connected to the counter is energized and releases the plate 10 to pivot into the path of the incoming sheets and intercept them. The plate 10 continues to lower as the stack builds thereon, and, a switch, such as switch 26 could be utilized for actuating the cylinder 19 to retract the plate 10 and permit the stack to pass to the support 64 on the table 11. At that time, the pivotting of the plate 10 about its pin 12 could actuate a switch such as in said patent, and such as switch 66 in FIG. 3, and that switch is shown connected to the two clutches 51 by electric lines 67 and 68. Therefore, the clutch 51 on the shaft 48 would be disengaged and that would permit the drive 43 to be effective in raising the plate 10 or in its "up" movement mentioned. However, at that same time, the clutch 51 on the shaft 47 would still be engaged and would therefore be inducing the desired downward movement of the table 11. Finally, as previously mentioned, the plate 10 would again pivot clockwise, as seen in FIG. 1, and that would again actuate the switch 66 and thereby energize the clutch 51 on shaft 48 and disconnect the clutch 51 on shaft 47 and thus create the respective downward movement of the plate 10 and the upward movement of the table 11.

The foregoing therefore discloses the invention of the system for alternately moving the separator plate and the stacker table up and down. This is accomplished by means of the constant running drive 43 and the two clutches 51. There are also the two sprockets or like members 61 which are lift means connected with the plate 10 and the table 11, respectively, for the upward movement of both, and they serve as two driven members operatively connected with the drive means 43. Therefore, in this novel system, there is no requirement for springs, fluid cylinders, dampeners, and other heretofore used mechanisms for returning both the separator plate 10 and the table 11 to their upward positions by inducing the upward movement with the mechanical elements just mentioned.

What is claimed is:

1. In a sheet stacker with a separator plate and having a movable stacker table with a stack supporter thereon, a movable separator plate, said stacker table and said separator plate being movably mounted for movement upward and downward along a path of stacking, drive means, two clutch means interconnected between said drive means and both said stacker table and said separator plate for the downward movement of both, lift means connected with both said stacker table and said separator plate for the upward movement of both, the improvement comprising said lift means including an additional single drive means operatively connected jointly with both said stacker table and said separator plate for the upward movement of both, and two driven members operatively interconnected between said additional single drive means and respectively with each of said stacker table and said separator plate for the alternate upward movement of said stacker table and said separator plate.

2. The sheet stacker with a separator plate, as claimed in claim 1, wherein said additional single drive means is a constantly running electric drive means.

3. The sheet stacker with a separator plate, as claimed in claim 1 or 2, wherein all said drive means and all said clutch means are electrical means, and including an electric switch electrically connected with said two clutch means for alternate electrical energizing of said two clutch means and thereby induce alternate downward movement of said stacker table and said separator plate.

4. The sheet stacker with a separator plate, as claimed in claim 3, including two rotatably mounted shafts in respective driven relation with each of said two clutch means, and said two driven members are sprockets rotatably drivingly interconnected with respective ones of said shafts for the alternate upward movement of said stacker table and said separator plate.

5. The sheet stacker with a separator plate, as claimed in claim 1 or 2, including a rotatably mounted shaft supporting both said two clutch means and said two driven members, and said two clutch means and said two driven members both including two sprockets mounted on each of the two said shafts for rotation therewith and with said sprockets being in respective driven relation with each of the two said drive means.

* * * * *